US008176837B1

(12) United States Patent
Jackson

(10) Patent No.: US 8,176,837 B1
(45) Date of Patent: May 15, 2012

(54) FIREARM OPERATING ROD

(76) Inventor: Jason Stewart Jackson, Atlanta, GA (US)

( * ) Notice: Subject to any disclaimer, the term of this patent is extended or adjusted under 35 U.S.C. 154(b) by 0 days.

(21) Appl. No.: 12/902,142

(22) Filed: Oct. 11, 2010

Related U.S. Application Data

(60) Provisional application No. 61/250,533, filed on Oct. 11, 2009.

(51) Int. Cl.
*F41A 5/24* (2006.01)

(52) U.S. Cl. ..... 89/193

(58) Field of Classification Search ..... 89/191.01, 89/191.02, 192, 193, 194
See application file for complete search history.

(56) References Cited

U.S. PATENT DOCUMENTS

| | | | | |
|---|---|---|---|---|
| 877,657 | A | 1/1908 | Mason | |
| 958,545 | A | 6/1909 | Ross | |
| 1,846,993 | A | 2/1932 | Destree | |
| 2,093,706 | A | 9/1937 | Browning | |
| 2,186,582 | A | 1/1940 | Gebauer | |
| 2,211,405 | A | 8/1940 | Browning | |
| 2,340,293 | A | 2/1944 | Balleisen | |
| 2,456,290 | A | 12/1948 | Ljutic | |
| 2,457,835 | A | 1/1949 | Schiff | |
| 2,462,119 | A | 2/1949 | Moore | |
| 2,484,694 | A | 10/1949 | Dicke | |
| 2,554,618 | A | 5/1951 | Dixon | |
| 2,582,989 | A | 1/1952 | Harvey | |
| 2,628,536 | A | 2/1953 | Schaich | |
| 2,637,247 | A | 5/1953 | Hester | |
| 2,777,366 | A | 1/1957 | Cook | |
| 2,887,013 | A | 5/1959 | Marsh | |
| 2,909,101 | A | 10/1959 | Hillberg | |
| 2,918,847 | A | 12/1959 | Barr | |
| 2,918,848 | A | 12/1959 | Maillard | |
| 2,951,424 | A | 9/1960 | Stoner | |
| 2,956,481 | A | 10/1960 | Barr | |
| 2,983,196 | A | 5/1961 | Dixon | |
| 2,987,968 | A | 6/1961 | Janson | |
| 3,088,378 | A | 5/1963 | Boudrcan | |
| 3,125,930 | A | 3/1964 | Gilbert | |
| 3,166,983 | A | 1/1965 | Lizza | |
| 3,207,036 | A | 9/1965 | Norton | |
| 3,306,168 | A | 2/1967 | Blumrick | |
| 3,330,183 | A * | 7/1967 | Loffler | 89/193 |
| 3,365,828 | A | 1/1968 | Badali | |
| 3,424,053 | A | 1/1969 | Close | |
| 3,443,477 | A | 5/1969 | Kaempf | |

(Continued)

OTHER PUBLICATIONS

AK-47 Instruction & Safety Manual.

(Continued)

*Primary Examiner* — Troy Chambers

(57) ABSTRACT

The embodiments of the present invention generally provide or relate to an operating rod for use in an auto-loading firearm. More specifically, embodiments of the present invention provide an operating rod for selectively actuating a bolt carrier by gas-impingement or mechanical operation. The operating rod can comprise an operating rod gas duct coupled to an operating rod gas tube, wherein gases from a fired cartridge are directed into the gas duct and flow through the gas tube to actuate a bolt carrier by gas-impingement. Alternatively, gases from a fired cartridge can be directed against a forward-end of the operating rod, thereby causing the operating rod to mechanically operate the bolt carrier.

21 Claims, 12 Drawing Sheets

U.S. PATENT DOCUMENTS

| | | | | | |
|---|---|---|---|---|---|
| 3,444,641 | A | | 5/1969 | Ruger | |
| 3,568,564 | A | | 3/1971 | Badali | |
| 3,592,101 | A | | 7/1971 | Jarvis et al. | |
| 3,601,002 | A | | 8/1971 | Janson | |
| 3,618,457 | A | | 11/1971 | Miller | |
| 3,657,960 | A | | 4/1972 | Badali | |
| 3,680,434 | A | | 8/1972 | Muhlemann | |
| 3,690,219 | A | | 9/1972 | Mumemann | |
| 3,707,110 | A | | 12/1972 | Alday | |
| 3,709,092 | A | | 1/1973 | Tazome | |
| 3,715,955 | A | * | 2/1973 | Folley et al. | 89/193 |
| 3,736,839 | A | | 6/1973 | Childers | |
| 3,774,500 | A | | 11/1973 | Into | |
| 3,776,096 | A | | 12/1973 | Donovan | |
| 3,810,412 | A | | 5/1974 | Zamacola | |
| 3,848,511 | A | | 11/1974 | Zanoni | |
| 3,869,961 | A | | 3/1975 | Kawamura | |
| 3,886,844 | A | | 6/1975 | Kepplinger | |
| 3,945,296 | A | | 3/1976 | Hyytinen | |
| 3,968,727 | A | | 7/1976 | Hyytinen | |
| 3,988,964 | A | | 11/1976 | Moore | |
| 3,990,348 | A | | 11/1976 | Vesamaa | |
| 3,999,534 | A | | 12/1976 | Chapin | |
| 4,010,673 | A | | 3/1977 | Kepplinger | |
| 4,014,247 | A | | 3/1977 | Tollinger | |
| 4,015,512 | A | | 4/1977 | Feerick | |
| 4,019,423 | A | | 4/1977 | Johnson | |
| 4,028,994 | A | | 6/1977 | Ferluga | |
| 4,058,922 | A | | 11/1977 | Elbe | |
| 4,061,075 | A | | 12/1977 | Smith | |
| 4,085,654 | A | | 4/1978 | Panigoni | |
| 4,095,507 | A | | 6/1978 | Close | |
| 4,102,242 | A | | 7/1978 | Liedke | |
| 4,102,243 | A | | 7/1978 | Jennie | |
| 4,109,558 | A | | 8/1978 | Panigoni | |
| 4,125,054 | A | | 11/1978 | Jennie | |
| 4,126,077 | A | | 11/1978 | Quesnel | |
| 4,151,782 | A | | 5/1979 | Allen | |
| 4,174,654 | A | | 11/1979 | Liedke | |
| 4,178,832 | A | * | 12/1979 | Crowell | 89/159 |
| 4,207,798 | A | | 6/1980 | Hayashi | |
| 4,244,273 | A | | 1/1981 | Langendorfer | |
| 4,279,191 | A | | 7/1981 | Johansson | |
| 4,324,170 | A | * | 4/1982 | Healy | 89/159 |
| 4,335,643 | A | | 6/1982 | Gal | |
| 4,373,423 | A | | 2/1983 | Moore | |
| 4,389,920 | A | | 6/1983 | Dufour | |
| 4,395,838 | A | | 8/1983 | Civolani | |
| 4,395,937 | A | | 8/1983 | Ottolini | |
| 4,409,883 | A | | 10/1983 | Nyst | |
| 4,414,880 | A | | 11/1983 | Throner | |
| 4,433,610 | A | | 2/1984 | Tatro | |
| 4,433,611 | A | | 2/1984 | Baumann | |
| 4,475,438 | A | | 10/1984 | Sullivan | |
| 4,505,183 | A | | 3/1985 | Grehl | |
| 4,538,502 | A | | 9/1985 | Benelli | |
| 4,563,937 | A | | 1/1986 | White | |
| 4,599,934 | A | | 7/1986 | Palmer | |
| 4,604,942 | A | | 8/1986 | Benelli | |
| 4,619,184 | A | | 10/1986 | Shalev | |
| 4,649,800 | A | | 3/1987 | Tessier | |
| 4,658,702 | A | | 4/1987 | Tatro | |
| 4,702,146 | A | | 10/1987 | Ikeda | |
| 4,709,617 | A | | 12/1987 | Anderson | |
| 4,765,224 | A | | 8/1988 | Morris | |
| 4,817,496 | A | | 4/1989 | Zedrosser | |
| 4,821,621 | A | | 4/1989 | Lorenzo | |
| 4,872,392 | A | | 10/1989 | Powers | |
| 4,901,623 | A | | 2/1990 | Lee | |
| 5,103,714 | A | | 4/1992 | LaFrance | |
| 5,123,329 | A | | 6/1992 | Irwin | |
| 5,173,564 | A | | 12/1992 | Hammond | |
| 5,218,163 | A | | 6/1993 | Dabrowski | |
| 5,272,956 | A | | 12/1993 | Hudson | |
| 5,274,939 | A | | 1/1994 | Scaramucci | |
| 5,279,202 | A | | 1/1994 | Bellardi | |
| 5,287,642 | A | | 2/1994 | Scaramucci | |
| 5,351,598 | A | | 10/1994 | Schuetz | |
| 5,404,790 | A | | 4/1995 | Averbukh | |
| 5,429,034 | A | | 7/1995 | Badali | |
| 5,448,940 | A | | 9/1995 | Schuetz | |
| 5,499,569 | A | | 3/1996 | Schuetz | |
| 5,520,019 | A | | 5/1996 | Schuetz | |
| 5,551,179 | A | | 9/1996 | Young | |
| 5,628,137 | A | | 5/1997 | Cortese | |
| 5,634,288 | A | | 6/1997 | Martel | |
| 5,726,377 | A | | 3/1998 | Harris | |
| 5,737,865 | A | | 4/1998 | Brandl | |
| 5,760,328 | A | | 6/1998 | Robbins | |
| 5,767,434 | A | | 6/1998 | Hirtl et al. | |
| 5,768,818 | A | | 6/1998 | Rustick | |
| 5,824,943 | A | | 10/1998 | Guhring | |
| 5,827,991 | A | | 10/1998 | Predazzer | |
| 5,827,992 | A | | 10/1998 | Harris | |
| 5,834,678 | A | | 11/1998 | Kalb | |
| 5,872,323 | A | | 2/1999 | Norton | |
| 5,937,558 | A | | 8/1999 | Gerard | |
| 5,939,659 | A | | 8/1999 | Dobbins | |
| 5,945,626 | A | | 8/1999 | Robbins | |
| 5,959,234 | A | | 9/1999 | Scaramucci | |
| 5,983,549 | A | | 11/1999 | Battaglia | |
| 6,019,024 | A | | 2/2000 | Robinson | |
| 6,029,645 | A | | 2/2000 | Wonisch | |
| 6,182,389 | B1 | | 2/2001 | Lewis | |
| 6,243,978 | B1 | | 6/2001 | Vignaroli | |
| 6,276,354 | B1 | | 8/2001 | Dillon | |
| 6,343,536 | B1 | | 2/2002 | Rossier | |
| 6,374,528 | B1 | | 4/2002 | Davis | |
| 6,374,720 | B1 | | 4/2002 | Tedde | |
| 6,382,073 | B1 | | 5/2002 | Beretta | |
| 6,405,631 | B1 | | 6/2002 | Milek | |
| 6,508,160 | B2 | | 1/2003 | Beretta | |
| 6,609,319 | B1 | | 8/2003 | Olson | |
| 6,619,592 | B2 | | 9/2003 | Vignaroli | |
| 6,622,610 | B2 | | 9/2003 | Adkins | |
| 6,634,274 | B1 | | 10/2003 | Herring | |
| 6,662,485 | B2 | | 12/2003 | Kay | |
| 6,681,677 | B2 | | 1/2004 | Herring | |
| 6,775,942 | B2 | | 8/2004 | Compton | |
| 6,834,455 | B2 | | 12/2004 | Burigana | |
| 6,848,351 | B1 | * | 2/2005 | Davies | 89/191.01 |
| 6,886,286 | B2 | | 5/2005 | Dowding | |
| 6,889,461 | B2 | | 5/2005 | Vignaroli | |
| 6,971,202 | B2 | | 12/2005 | Bender | |
| 7,131,228 | B2 | | 11/2006 | Hochstrate | |
| 7,137,217 | B2 | | 11/2006 | Olson | |
| 7,162,822 | B1 | | 1/2007 | Heayn | |
| 7,162,823 | B2 | | 1/2007 | Schoppman | |
| 7,225,574 | B2 | | 6/2007 | Crandall | |
| 7,231,864 | B2 | | 6/2007 | Ratti | |
| 7,252,138 | B2 | | 8/2007 | Burkhalter | |
| 7,311,032 | B2 | | 12/2007 | Murello | |
| 7,316,091 | B1 | | 1/2008 | Desomma | |
| 7,337,574 | B2 | | 3/2008 | Crandall et al. | |
| 7,343,844 | B2 | | 3/2008 | Poff, Jr. | |
| 7,347,021 | B1 | | 3/2008 | Jones | |
| 7,356,957 | B1 | | 4/2008 | Jones | |
| 7,418,898 | B1 | | 9/2008 | Desomma | |
| 7,448,307 | B1 | | 11/2008 | Dafinov | |
| 7,461,581 | B2 | | 12/2008 | Leitner-Wise | |
| 7,469,624 | B1 | | 12/2008 | Adams | |
| 7,587,956 | B2 | | 9/2009 | Velasco | |
| 7,610,843 | B2 | | 11/2009 | Beretta | |
| 7,610,844 | B2 | | 11/2009 | Kuczynko | |
| 7,617,758 | B2 | | 11/2009 | Gavage | |
| 7,621,210 | B2 | | 11/2009 | Fluhr | |
| 7,634,959 | B2 | | 12/2009 | Frickey | |
| 7,637,199 | B2 | | 12/2009 | Fluhr | |
| 7,661,220 | B2 | | 2/2010 | Crandall | |
| 7,739,939 | B2 | | 6/2010 | Adams | |
| 7,775,149 | B2 | | 8/2010 | Keeney | |
| 7,779,743 | B2 | | 8/2010 | Herring | |
| 7,874,240 | B2 | | 1/2011 | Akhavan | |
| 7,946,214 | B2 | | 5/2011 | Stone | |
| 7,971,379 | B2 | | 7/2011 | Robinson | |
| 7,971,518 | B2 | * | 7/2011 | Adams | 89/191.01 |

| | | | | |
|---|---|---|---|---|
| 2007/0199435 | A1 | 8/2007 | Hochstrate | |
| 2009/0031607 | A1 | 2/2009 | Robinson | |
| 2011/0023700 | A1 * | 2/2011 | Herring | 89/193 |

OTHER PUBLICATIONS

AK-47 Semi-Automatic Rifle.
Armalite Inc Owner's Manual for AR-180B rifle, Armalite, Inc., Jun. 2009.
Barrett Operator's Manual .50 Caliber Rifle M82A1.
CMMG Piston Maintenance and Disassembly Instructions.
Czech Model Vz 52 & Vz 52/57 Rifles Operation and Maintenance Manual.
Exploded view of G41(W). Retrieved from the Internet:<http://claus.espeholt.dk/exploded_view_g41.html>.
FAL User's Manual Light Automatic Rifle, Fabrique Nationale Herstal.
Gewehr 41, Wikipedia. Retrieved from the Internet<http://en.wikipedia.org/wiki/Gewehr_41>.
M6 Series Carbines Operator's Manual, LWRC International, LLC.
Magpul Masada Adaptive Combat Weapon System, Magpul Military Industries.
Shea, Dan, *British SA80 Rifles, The L85A1 and L86A1 LSW*, The Small Arms Review, vol. 6, No. 3, Dec. 2002.
SIG Sauer SIG556 Handling & Safety Instructions.
T-14, 36 (410) Calibre Semi-Automatic Shotgun User and Maintenance Manuel, Safir Arms Industrial Company Ltd.
Windham, Jeff, *Fire to Destruction Test of 5.56 M4A1 Carbine and M16A2 Rifle Barrels*, Final Report, Small Arms Branch, Engineering Support Directorate, Rock Island Arsenal, Sep. 1996.

* cited by examiner

FIREARM OPERATING ROD

CROSS-REFERENCE TO RELATED APPLICATIONS

This application claims priority to U.S. Provisional Application Ser. No. 61/250,533, entitled OPERATING ROD FOR SELECTIVELY ACTUATING A BOLT CARRIER BY GAS IMPINGEMENT OR MECHANICAL OPERATION, filed Oct. 11, 2009, which is herein incorporated by reference in its entirety.

SUMMARY OF THE INVENTION

A first embodiment of the present invention provides an operating rod for selectively actuating a bolt carrier by gas-impingement or mechanical operation. The operating rod of various embodiments can comprise an operating rod gas tube and an operating rod gas duct coupled to the operating rod gas tube.

Another embodiment provides an operating rod comprising an operating rod gas tube and an operating rod gas duct coupled to the operating rod gas tube, wherein expansion gases are directed into the operating rod gas duct and flow through the operating rod gas tube when the operating rod is used for gas-impingement. The operating rod can also reciprocate when expansion gases are directed against a forward-end or portion of the operating rod. Accordingly, the operating rod can be used for selective gas-impingement or mechanical operation.

A further embodiment provides an operating rod for actuating a bolt carrier, the operating rod comprising an operating rod gas tube and an operating rod gas duct coupled to the operating rod gas tube, wherein expansion gases flowing or directed into the operating rod gas duct and through the operating rod gas tube actuate the bolt carrier when the operating rod is in a first recoil mode. The operating rod can further comprise a forward-end, such as a piston, wherein the operating rod transmits an actuating force to the bolt carrier in a second recoil mode when expansion gases act against the forward-end of the operating rod.

Yet another embodiment provides a system for actuating a bolt carrier. The system comprises an operating rod including an operating rod gas duct coupled to an operating rod gas tube, wherein the operating rod gas duct receives expansion gases as a function of one or more battery states. The system can comprise at least a first battery state and a second battery state. The first battery state can comprise positioning a forward-end of the operating rod, such as a piston, in a gas block to define an expansion chamber, wherein in the first battery state expansion gases flow into the expansion chamber and act against the forward-end of the operating rod, causing the operating rod to reciprocate and thereby mechanically actuate the bolt carrier, for example. The second battery state can comprise positioning the operating rod gas duct to receive expansion gases, wherein expansion gases flow from the operating rod gas duct and through the operating rod gas tube to actuate the bolt carrier such as by gas-impingement, for example.

Another embodiment provides a method for operating a firearm, wherein the firearm includes a bolt carrier carried in a receiver, a barrel coupled to the receiver, a gas block coupled to the barrel and including a gas port for tapping expansion gases from the barrel, and an operating rod that comprises an operating rod gas tube coupled to an operating rod gas duct. The method first comprises placing the firearm in piston-driven mode. Second, while in piston-driven mode first expansion gases are received from a first fired cartridge against a forward-end of the operating rod, wherein the first expansion gases act against the operating rod and cause it to transmit an actuating force to, such as by reciprocating against and/or with, the bolt carrier. Third, the firearm is placed in gas-impingement mode. Fourth, while in gas-impingement mode second expansion gases are received from a second fired cartridge into the operating rod gas duct, wherein the second expansion gases flow through the operating rod gas tube and actuate the bolt carrier.

A further embodiment provides a method for modifying a firearm to selectively operate in one of a gas-impingement or a piston-driven mode, wherein the firearm includes a bolt carrier carried in a receiver, a barrel coupled to the receiver, and an existing gas block coupled to the barrel. The method first comprises removing the existing gas block from the firearm. Second, a replacement gas block is attached to the barrel. Third, a rear end of the operating rod is located through an opening in the receiver, wherein the operating rod includes an operating rod gas tube coupled to an operating rod gas duct, wherein expansion gases flowing through the replacement gas block are received into the operating rod gas duct and flow through the operating rod gas tube to actuate the bolt carrier when the firearm is in the gas-impingement mode. Fourth, a forward-end of the operating rod is located in a receiving portion of the replacement gas block, wherein expansion gases in the replacement gas block act against the forward-end of the operating rod to transmit an actuating force to the bolt carrier when the firearm is in the piston-driven mode.

Unless otherwise expressly stated, it is in no way intended that any embodiment set forth herein be construed as requiring that its steps or process be performed in a specific order. This holds for any possible non-express basis for interpretation, including matters of logic with respect to arrangement of steps or operational flow, plain meaning derived from grammatical organization or punctuation, or the number or type of embodiments described in the specification.

BRIEF DESCRIPTION OF THE DRAWINGS

The accompanying drawings, which are incorporated in and constitute part of this specification, illustrate embodiments of the invention, and together with the description, serve to explain the principles of various embodiments of the invention. The embodiments described in the drawings and specification in no way limit or define the scope of the present invention.

DETAILED DESCRIPTION OF THE INVENTION

The present invention has been illustrated in relation to embodiments which are intended in all respects to be illustrative rather than restrictive. Those skilled in the art will realize that the present invention is capable of many modifications and variations without departing from the scope of the present invention.

Figure 1:
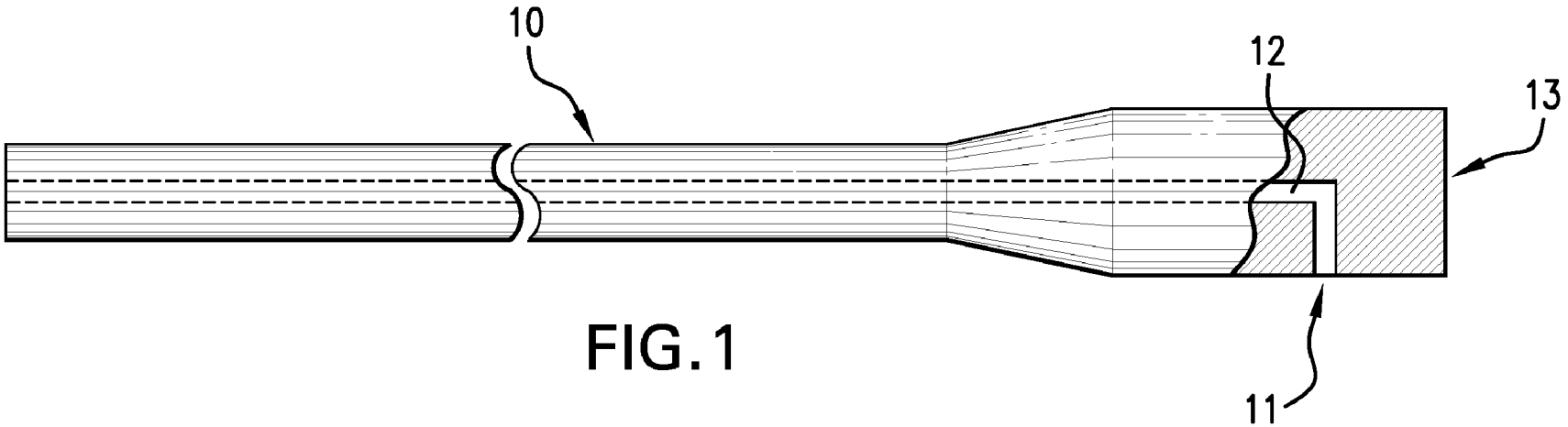
FIG. 1 is a partial sectional side view of an operating rod of one embodiment of the present invention.
Figure 2:
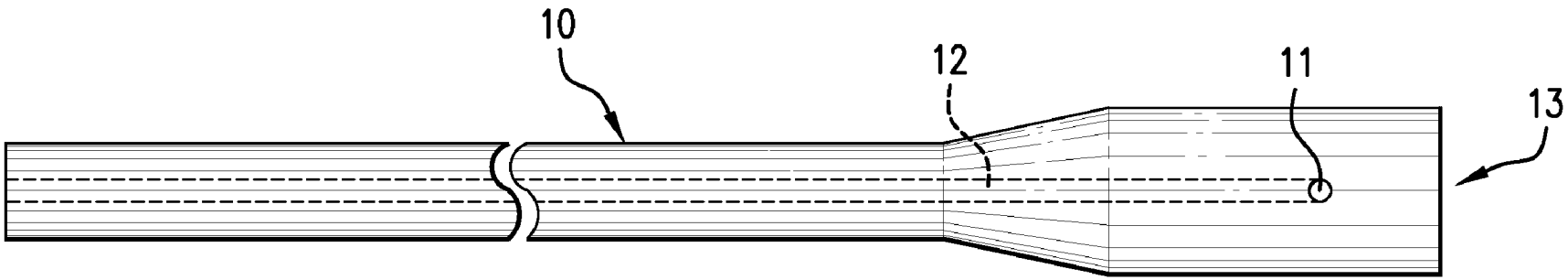
FIG. 2 is a side view of the operating rod shown in FIG. 1.

The embodiments of the present invention generally relate to apparatuses, systems, and methods that include or comprise an operating rod for an auto-loading firearm. The operating rod of embodiments of the present invention can comprise an operating rod gas tube and an operating rod gas duct coupled to the operating rod gas tube. FIGS. 1 and 2, for example, show one such embodiment. As shown in FIGS. 1 and 2, the operating rod 10 includes an operating rod gas duct 11 coupled to an operating rod gas tube 12. The operating rod 10 can be used to actuate or operate the bolt carrier of a firearm by gas-impingement (also referred to as "direct impingement") when expansion gases from a fired cartridge are directed into the operating rod gas duct 11 and flow to the bolt carrier along operating rod gas tube 12. The operating rod 10 also includes a forward-end or piston 13. The operating rod 10 can also be used to mechanically actuate or operate (also known as "operating-rod", "rod-driven", or "piston-driven" operation) the bolt carrier when expansion gases from a fired cartridge are directed against the piston 13, thereby causing the piston to move rearward and transfer an actuating force to the bolt carrier.

An operating rod gas tube such as operating gas tube 12 can be carried within the operating rod of any embodiment of the present invention. The operating rod of any embodiment of the present invention can comprise any shape, including circular, substantially circular, elliptical, polygonal, and the like including combinations thereof, and the operating rod may have different shapes or sizes at different lengths. Similarly, an operating rod gas tube such as operating gas tube 12 can comprise any shape including circular, substantially circular, elliptical, polygonal, and the like including combinations thereof, and the operating rod gas tube can have different shapes or diameters at different positions in the operating rod. Moreover, the operating rod gas duct 11 can comprise any suitable size or shape in embodiments of the present invention including circular, substantially circular, elliptical, polygonal, and the like including combinations thereof. The operating rod of any embodiment can comprise a metal such as iron alloys including steel, titanium alloys, or aluminum alloys. The forward-end of the operating rod or piston 13 can have the same, or a different, diameter from the rest of operating rod 10 as shown, for example, in FIGS. 1 and 2. For example, in various embodiments such as shown in FIGS. 1 and 2 the piston 13 can have a larger diameter than the rest of the operating rod 10. The piston 13 can be integrated with or attachable to the operating rod in any embodiment of the present invention.

Accordingly, the operating rod, such as operating rod 10, of embodiments of the present invention can be used to selectively actuate a bolt carrier by either gas-impingement or mechanical actuation by directing expansion gases from a fired cartridge either into the gas duct 11 or against the piston 13. Moreover, the operating rod of embodiments of the present invention can be used with or incorporated into any embodiment of the present invention, including without limitation the systems, firearms, and methods described herein.

Further embodiments of the present invention provide or include operating rods wherein the forward-end includes a recess that forms part of a chamber that receives gases from a fired cartridge (also known as an "expansion chamber") when the operating rod is being used to mechanically actuate a bolt carrier. FIGS. 3-10 and 13-14 show such embodiments, although a recessed piston can be used or combined with any embodiment of the present invention.

Figure 3:
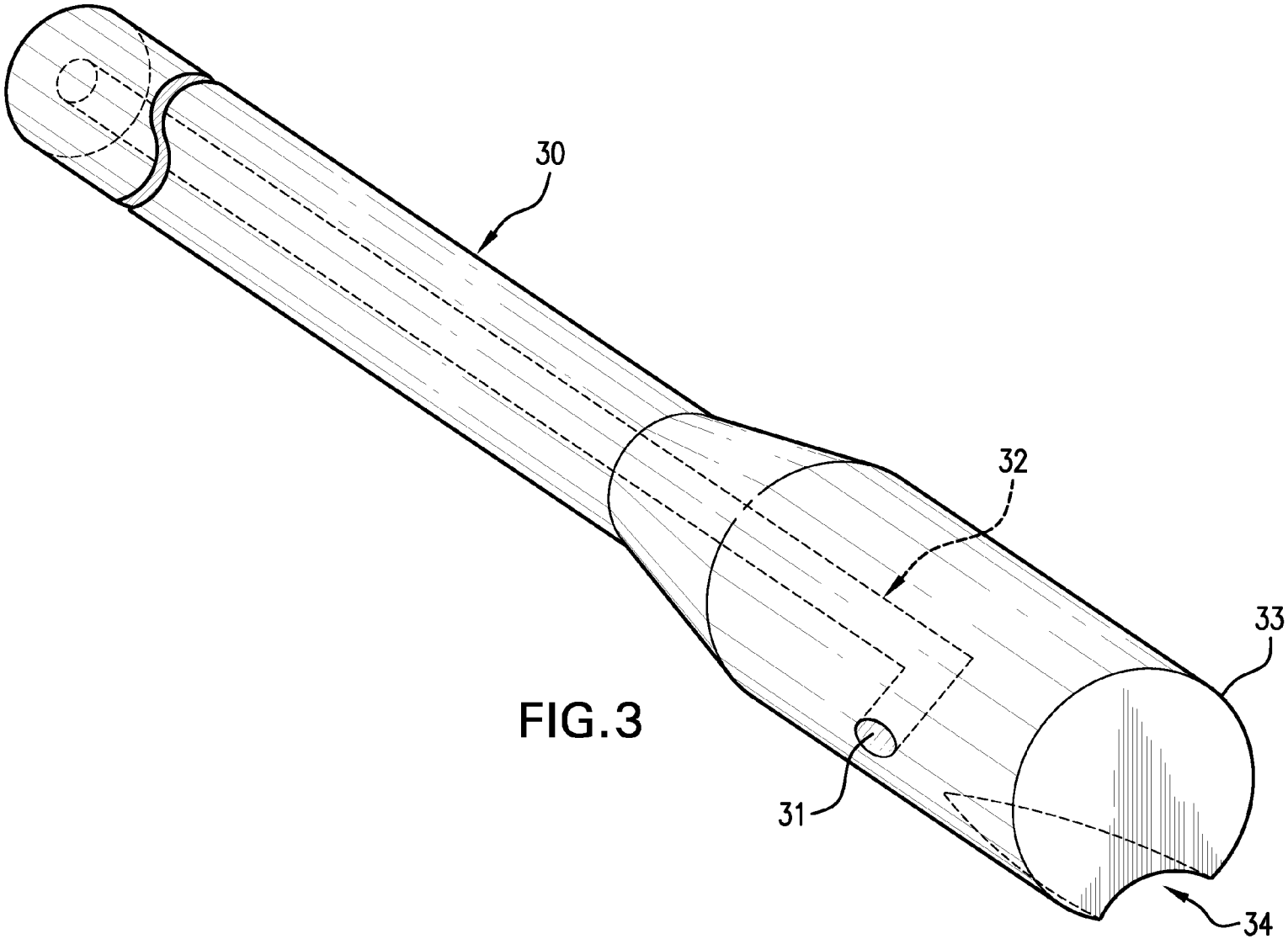
FIG. 3 is a perspective view of an operating rod of another embodiment of the present invention wherein the operating rod includes a recess.

As shown in FIG. 3, the operating rod 30 includes an operating rod gas duct 31 coupled to an operating rod gas tube 32. The operating rod 30 also includes a forward-end or piston 33 with a recess 34. The recess 34 forms part of an expansion chamber—that is the recess 34 directly receives pressure from expansion gases—when the operating rod 30 is being used to mechanically actuate a bolt carrier.

The recess of any embodiment of the present invention, such as recess 34, can comprise a beveled edge, groove, or any other suitably shaped space in the forward-end 33 of an operating rod 30. As shown in FIG. 3, the recess 34 can extend from the front of the piston 33 to a point, such as the center of the operating rod 30, and can decrease in depth from the forward-end of the operating rod 30 to the point. A gas duct 31 as shown in FIG. 3 for example can be located at a depth from the face of piston 33 that is less than or equal to the depth of the recess 34. The gas duct 31 and recess 34 can be at different angles relative to the long axis of the operating rod 30 as shown in FIG. 3.

The operating rod 30 can be used to actuate a bolt carrier of a firearm by gas-impingement when expansion gases from a fired cartridge are directed into the operating rod gas duct 31 and flow to the bolt carrier along the operating rod gas tube 32. The operating rod 30 can also be used to mechanically actuate the bolt carrier when expansion gases from a fired cartridge are directed against the piston 33, thereby causing the operating rod 30 to transfer an actuating force to the bolt carrier.

When an operating rod of the present invention, such as the operating rods shown in FIGS. 3-10 and 13-14, are being used for piston-driven operation (such as in the first recoil mode, described below) the recess is used to selectively expose the forward-end of the operating rod to gases from a fired cartridge, such as by uncovering a gas port in communication with a barrel, thus enabling expansion gases to push against the operating rod and actuate a bolt carrier. When the operating rod, such as the operating rods shown in FIGS. 3-10 and 13-14, is being used for gas-impingement operation (such as in the second recoil mode, described below) the operating rod can be positioned such as by rotating the operating rod 30 and/or by moving it longitudinally so that the gas duct, such as gas duct 31, receives gases from a fired cartridge. Those gases then flow down the gas tube, such as gas tube 32, and are used to actuate a bolt carrier. Accordingly, the recessed piston of any embodiment of the present invention can be used to selectively operate a bolt carrier by either gas-impingement or mechanical operation.

The operating rod of any embodiment of the present invention can be locked into position with respect to a gas block, barrel, and/or receiver to receive gases from a fired cartridge for gas-impingement operation. As used herein, locking an operating rod into position with respect to a bolt carrier means that the operating rod does not move with the bolt carrier. As shown for example in FIGS. 4-10 and 13-14, the operating rod of any embodiment of the present invention can include one or more lugs to lock the operating rod in position so that it does not move with respect to a bolt carrier, gas block, barrel, and/or receiver. A lug can engage a bearing surface to lock an operating rod in place and thereby prevent it from reciprocating when it is being used for gas-impingement operation.

Figure 4:
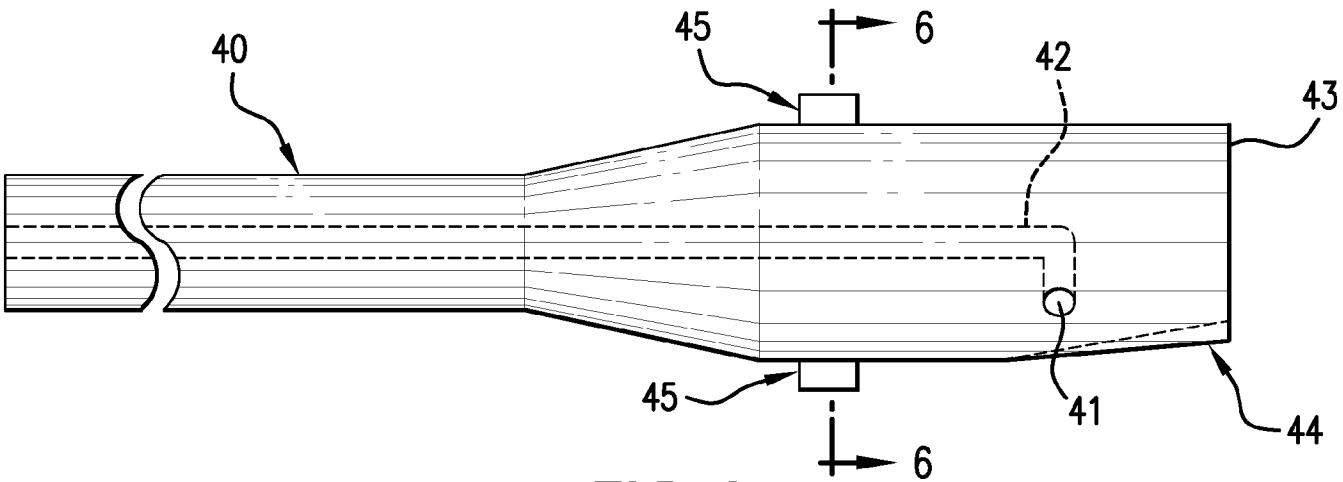
FIG. 4 is a side view of an operating rod of another embodiment of the present invention wherein the operating rod includes a recess and two lugs.

By way of example, FIG. 4 shows an operating rod like the one shown in FIG. 3 with the addition of lugs. As shown in FIG. 4, the operating rod 40 includes an operating rod gas duct 41 coupled to an operating rod gas tube 42. The operating rod 40 also includes a piston 43 with a recess 44. The lugs 45 can engage one or more bearing surfaces to lock the operating rod 40 into position, preventing it from reciprocating, when the operating rod 40 is being used for gas-impingement operation. The lugs 45 can also be used to guide the operating rod 40 as it reciprocates when it is used to mechanically actuate a bolt carrier. As shown in FIGS. 6-10 and 13-14, for example, an operating rod can include a pair of lugs that ride in corresponding grooves in a gas block attached to a barrel. The gas block of any embodiment can comprise a metal such as iron alloys including steel, titanium alloys, or aluminum alloys. As the operating rod reciprocates, the lugs, such as lugs 45, maintain the operating rods rotational orientation and so act to consistently align the recess 44 with the gas port when the operating rod 40 returns forward. The one or more lugs can be coupled to any suitable part of the operating rod in embodiments of the present invention. For example, a lug can be located on the forward-end or piston of the operating rod as shown in FIGS. 4-10 and 13-14.

The operating rod of any embodiment of the present invention can receive expansion gases from a gas port that is used to tap expansion gases from a barrel. FIGS. 6-10 and 13-15 show embodiments of the present invention where an operating rod receives expansion gases from a gas port.

Figure 7:
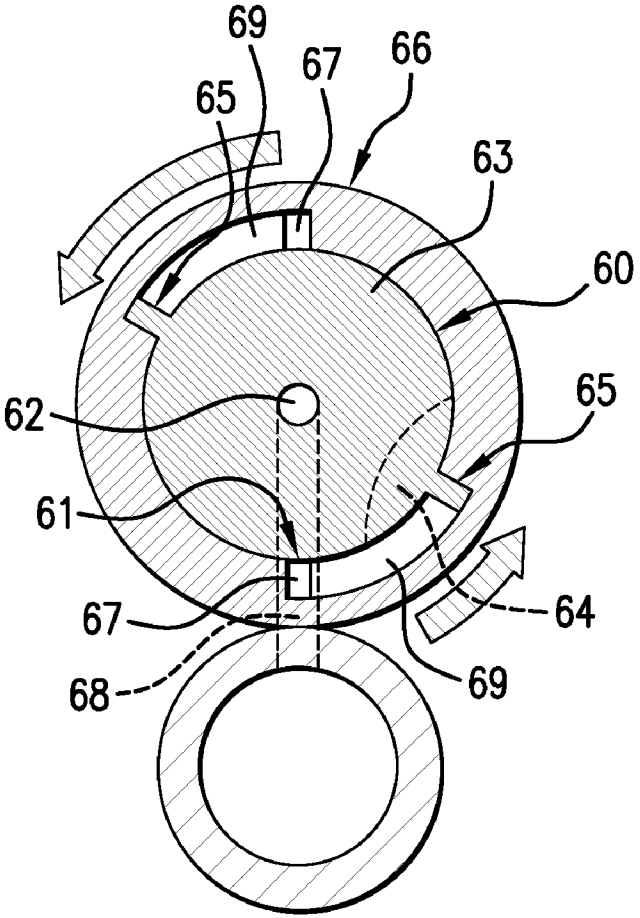
FIG. 7 is a cross-sectional front view of the embodiment of FIG. 6 with the operating rod positioned for gas-impingement operation.
Figure 6:
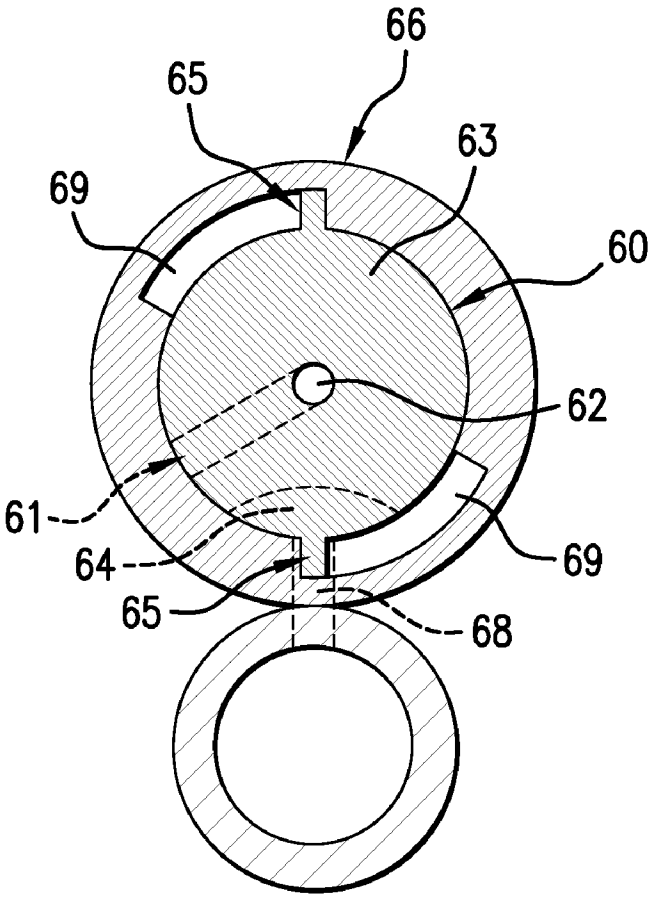
FIG. 6 is a cross-sectional front view of one embodiment of the present invention wherein an operating rod is positioned for piston-driven operation.
Figure 8:
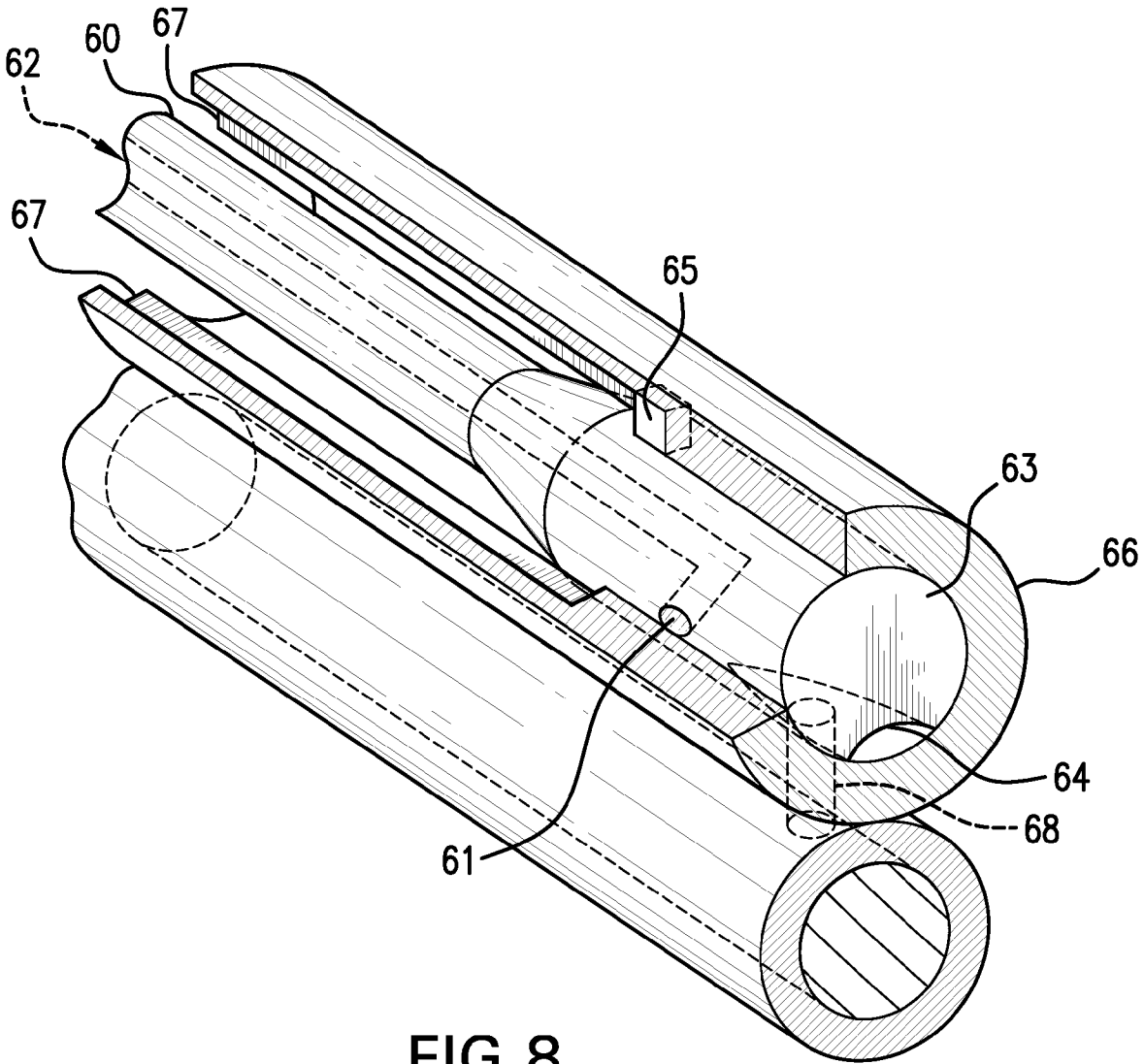
FIG. 8 is a partial sectional perspective view of the embodiment of FIG. 6.

As shown in FIGS. 6-8 the operating rod 60 includes an operating rod gas duct 61 coupled to an operating rod gas tube 62. The operating rod 60 also includes a piston or forward-end 63 with a recess 64 and lugs 65. As shown in FIGS. 6 and 8, the recess 64 can be positioned over or aligned with the gas port 68 to allow expansion gases to enter an expansion chamber defined by the gas block 66 and the piston 63. The operating rod 60 can then reciprocate along grooves 67 in the gas block 66 when expansion gases act against the piston 63, thereby mechanically actuating a bolt carrier. As shown in FIG. 7, the operating rod 60 can also be positioned to receive expansion gases from the gas port 68 into the gas duct 61 for gas-impingement operation by rotating the operating rod 60 relative to its position in FIGS. 6 and 8 to align the gas duct 61 with the gas port 68. Thus, the operating rod of embodiments of the present invention, such as the operating rod 60, can be transitioned between a first recoil mode comprising piston-driven operation and a second recoil mode comprising gas-impingement operation by rotating the operating rod 60 such that expansion gases from the gas port 68 are selectively directed against either the piston 63 or into the gas duct 61. Moreover, as shown in FIG. 7, rotating the operating rod 60 accomplishes both aligning the gas duct 61 with the gas port 68 and rotating lugs 65 so that they lock the operating rod 60 into the gas block 69.

Accordingly, embodiments of the present invention, such as those embodiments shown in FIGS. 1-10 and 13-14, provide operating rods and systems for actuating a bolt carrier, wherein an operating rod comprises an operating gas duct coupled to an operating gas tube. As shown in FIG. 4, for example, expansion gases can be directed into the gas duct 41 and flow through the operating rod gas tube 42 to actuate the bolt carrier by gas-impingement. The operating rod 40 can further comprise a forward-end or piston 43. Expansion gases can be directed against the piston 43 to mechanically actuate the bolt carrier. The operating rod 40 can thus be transitioned between gas-impingement and piston-driven operation by moving the operating rod to direct expansion gases either against the piston 43 or into the gas duct 41.

In further embodiments, such as those shown in FIGS. 3-10 and 13-14, the forward-end or piston of the operating rod can include a recess that forms part of an expansion chamber. The recess of any embodiment can comprise a beveled edge, groove, or any other suitable shape. As shown in FIG. 8, for example, the operating rod 60 can be used to mechanically actuate a bolt carrier by aligning the recess 64 with a gas port 68, allowing expansion gases to push against the piston 63 and thereby actuate a bolt carrier. Accordingly, a recessed piston 63 can be used to selectively operate a bolt carrier by either gas-impingement or piston-driven operation by rotating or otherwise moving the operating rod 60 to align a gas port 68 with either the gas duct 61 for gas-impingement operation or the recess 64 for piston-driven operation.

Additional embodiments of the present invention include one or more recoil modes or battery states that refer to how an operating rod will be used to actuate a bolt carrier. For example, in one embodiment the operating rod gas duct receives expansion gases from a gas port when the operating rod is in a first recoil mode, such as gas-impingement mode. The battery position of an operating rod 60 in the first recoil mode is thus shown for example in FIG. 7. The first recoil mode can comprise aligning the operating rod gas duct 61 with the gas port 68. The first recoil mode can also comprise creating a gas pathway between the operating rod gas duct 61 and the gas port 68. The operating rod 60 can also include a recess 64 that comprises part of a chamber than receives gases from a fired cartridge via a gas port 68 when the operating rod 60 is in a second recoil mode, such as piston-driven mode. As understood by one of skill in the art an auto-loading rifle, for example, is in battery when its bolt carrier and bolt are fully forward in a receiver. A firearm in battery will thus discharge if a cartridge is in the rear portion of a barrel (also known as the "chamber"), any safeties (if present) are deactivated, and the trigger is pulled.

The battery position of operating rod 60 in the second recoil mode is shown for example in FIGS. 6 and 8. The operating rod gas duct 61 can be located on a side of the operating rod 60 in any embodiment of the present invention. The gas port 68 can be located on the wall of the expansion chamber as shown in FIGS. 6-10 and 13-14.

Figure 10:
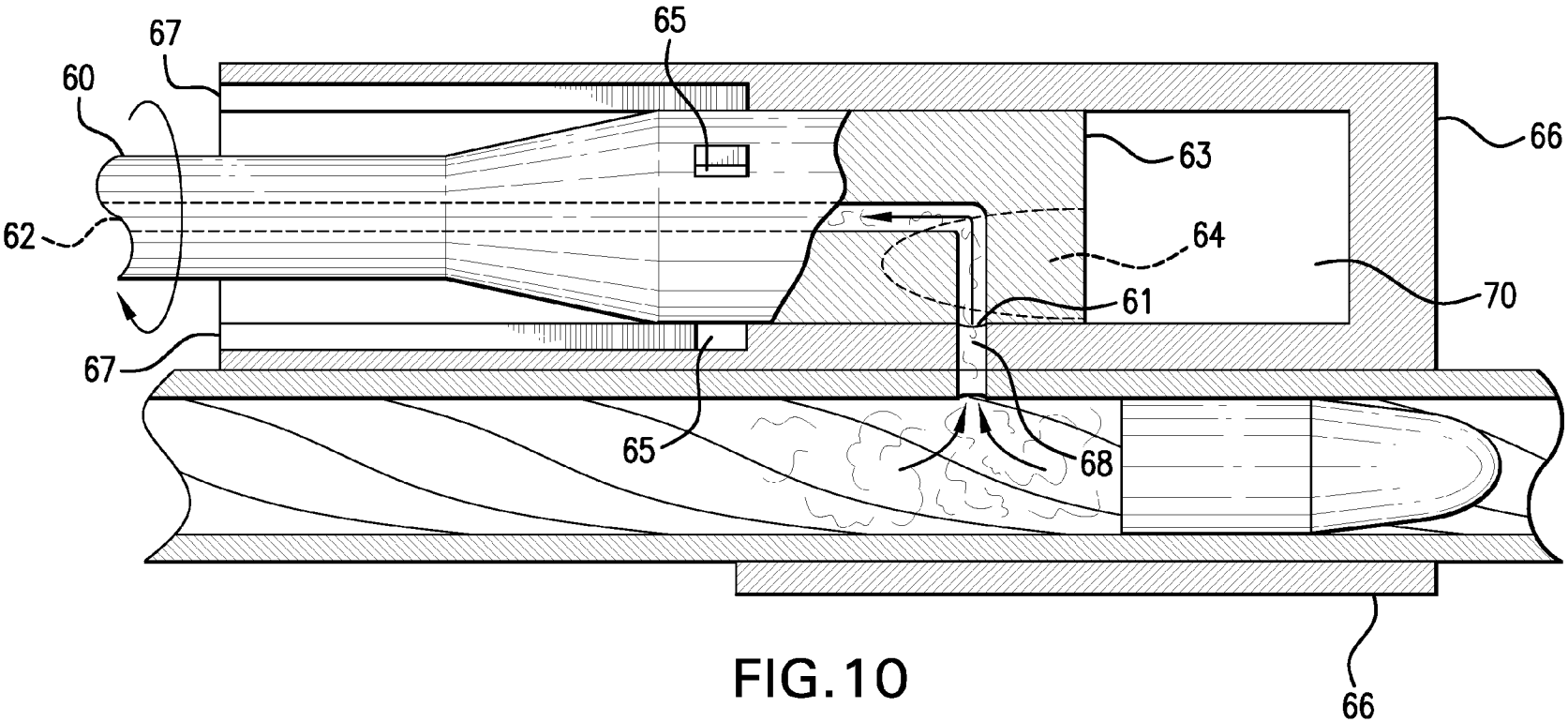
FIG. 10 is a partial sectional side view of the embodiment of FIG. 9 showing the moment after gases from a fired cartridge enter the gas duct of the operating rod.

As shown in FIGS. 7 and 10, for example, the operating rod of any embodiment can be positioned to receive expansion gases in a first recoil mode or battery state by rotating the operating rod relative to its position in a second recoil mode or battery state. In other words, the operating rod of any embodiment can be transitioned between two recoil modes or battery states by moving the operating rod so that expansion gases are either received by the operating rod gas duct or against the forward-end of the operating rod.

The operating rod of further embodiments of the present invention, such as shown in FIGS. 4-10 and 13-14 can be locked in position with respect to a bolt carrier in the first recoil mode. FIG. 7 shows the operating rod 60 of one embodiment locked into position using lugs 65. The lugs can be located on or behind the piston of an operating rod, and an operating rod can include one or more lugs. By way of example, FIG. 4 shows an operating rod 40 where two lugs 45 are located on the piston 43.

The lugs of any embodiment can lock an operating rod into position by engaging one or more bearing surfaces. As shown in FIGS. 6-10 and 13-14, for example, the bearing surfaces can be coupled to a gas block that includes the gas port, and can include a groove such as an "L" shaped groove for locking each lug into the gas block. FIG. 7 for example shows an "L" shaped groove 69 for locking an operating rod 60 into a gas block 66. A bearing surface can also be coupled to a barrel and/or a receiver in embodiments of the present invention.

A control pin can be used with the operating rod of any embodiment of the present invention, such as the embodiments shown FIGS. 1-10 and 13-14, as a means for a person to control the position and/or rotation of the operating rod. A control pin can be coupled to an operating rod at any suitable location, such as on or behind the forward-end of the operating rod. As shown for example in FIG. 5, the operating rod 40 of FIG. 4 can further include a control pin 46. The control pin 46 enables a user to rotate the operating rod 40 and engage or disengage the lugs 45, thereby locking the operating rod 40 in position for gas-impingement operation.

Figure 5:
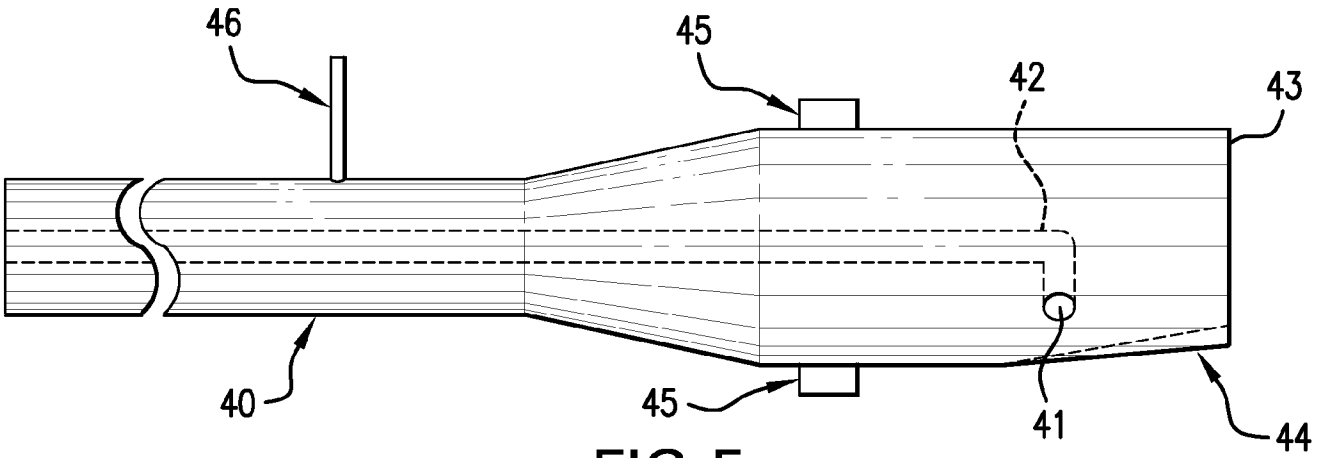
FIG. 5 is a side view of an operating rod of another embodiment of the present invention wherein the operating rod includes a recess, two lugs, and a control pin.

The control pin of any embodiment, including the control pin 46 of FIG. 5, can be received by a slot to guide the position and/or rotation of the operating rod 40. The slot can be located at various locations in embodiments of the present invention. For example, the slot can be coupled to a gas block that includes a gas port, the slot can be coupled to a hand guard, or the slot can be coupled to a receiver that carriers a bolt carrier in embodiments of the present invention.

Figure 11:
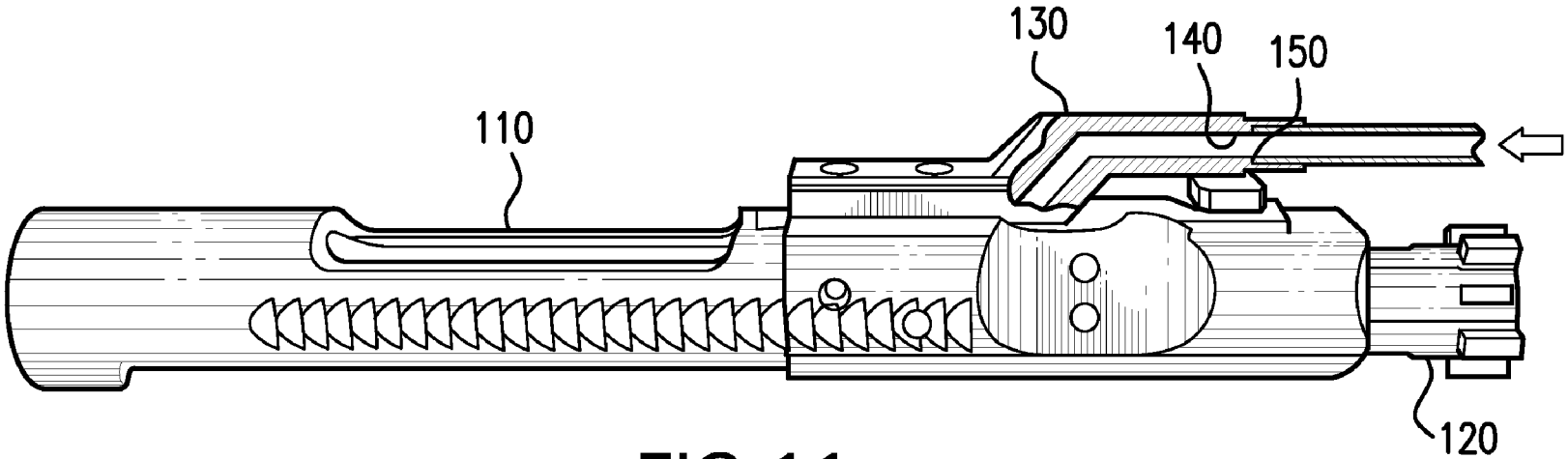
FIG. 11 is a side view of a bolt carrier, bolt, and carrier key useable with any embodiment of the present invention.

The operating rods, systems, and methods of the present invention can be used with any suitable bolt carrier. By way of example and as shown in FIG. 11, a conventional M-16/AR-15-type bolt carrier 110 and bolt 120 can be used with embodiments of the present invention. A modified carrier key 130 can enable use of a conventional M-16-type bolt carrier 110 and bolt 120 with the operating rod embodiments of the present invention, including the operating rods shown in FIGS. 1-10 and 13-14. The carrier key 130 can be integrated with or removable from the bolt carrier 110 in embodiments of the present invention.

The carrier key (also known as a "gas key") 130 can include a key port 140 for receiving expansion gases from the operating rod gas tube and for directing those gases into the bolt carrier 110 when the operating rod is being used for gas-impingement operation. As shown in FIG. 11 the end of an operating rod can rest inside the carrier key 130. For mechanical actuation the carrier key 130 can comprise a thrust surface 150, such as a circular shelf or face that receives the rear end of the operating rod, for example, to receive an actuating force from the operating rod.

Figure 12:
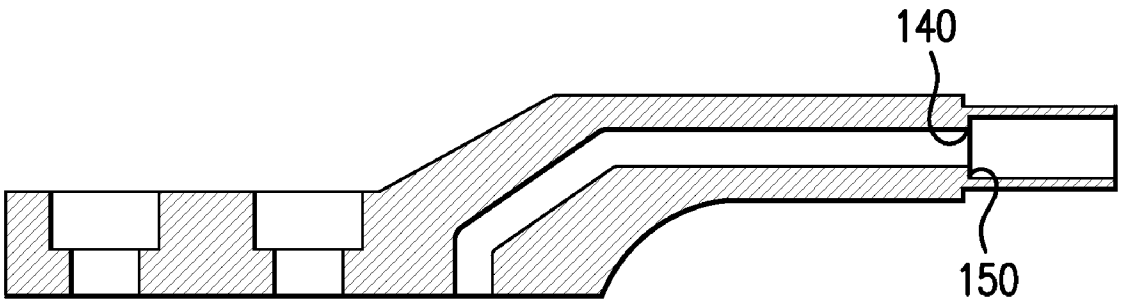
FIG. 12 is a cross-sectional side view of a carrier key useable with any embodiment of the present invention.

FIG. 12 shows in detail the carrier key 130, including the key port 140 and the thrust surface 150. As shown in FIGS. 11 and 12, the thrust surface 150 can comprise a circular shelf inside the carrier key 130 that receives a reciprocating force from an operating rod. Accordingly, an M-16-style bolt carrier 110 and bolt 120 with a modified carrier key 130 can be used with embodiments of the present invention.

Figure 9:
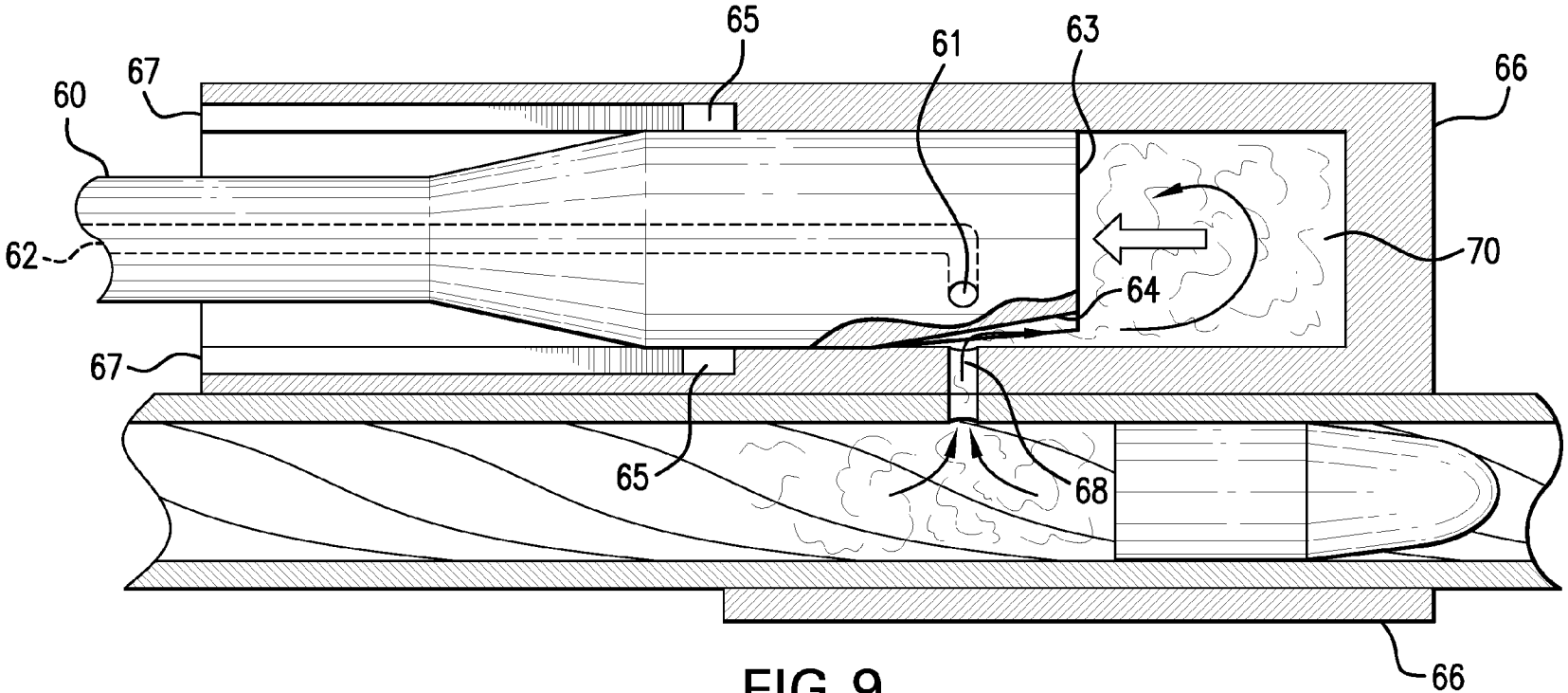
FIG. 9 is a partial sectional side view of an embodiment of the present invention showing the moment after gases from a fired cartridge enter an expansion chamber and act against an operating rod.

FIGS. 9 and 10 illustrate a further embodiment of the present invention wherein the operating rod 60 of FIG. 6 operates in a piston-driven and then in a gas-impingement mode. As shown in FIG. 9, the operating rod 60 includes an operating rod gas duct 61 coupled to an operating rod gas tube 62. The operating rod 60 also includes a piston 63 with a recess 64 that forms part of an expansion chamber 70 in a gas block 66 for piston-driven operation. As seen in FIG. 9, a bullet from a fired cartridge has just passed the gas port 68. Expansion gases from the fired cartridge are travelling through the gas port 68 and into the expansion chamber 70, where they are pushing against the piston 63. In the next moment (not shown) the expansion gases will push the operating rod 60 rearward and the piston 63 will travel in the gas block 66 guided by the grooves 67, thereby transferring force to and operating a bolt carrier.

FIG. 10 shows the embodiment of FIG. 9 with the operating rod 60 transitioned by rotation to gas-impingement mode. As shown in FIG. 10, the operating rod 60 has been rotated clockwise, thereby locking the operating rod 60 into the gas block 66 using the lugs 65 as well as aligning the gas port 68 with the gas duct 61. As seen in FIG. 10, a bullet from a fired cartridge has just passed the gas port 68. Expansion gases from the fired cartridge are travelling through the gas port 68, through the gas duct 61, and into the gas tube 62. The expansion gases will then travel down the gas tube 62 and into a bolt carrier (not shown) which will be operated by the expansion gases (i.e. gas-impingement operation). The operating rod 60 in FIG. 10 can be repositioned for piston-driven operation by rotating it counter-clockwise back into the configuration shown in FIG. 9. Accordingly, as shown in FIGS. 9 and 10, embodiments of the present invention provide operating rods, systems, and methods for selectively actuating a bolt carrier by either gas-impingement or mechanical operation.

Figure 14:
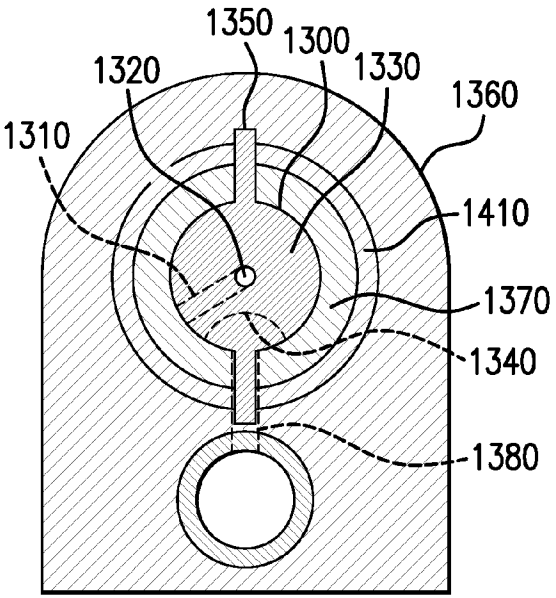
FIG. 14 is a cross-sectional view of the embodiment of FIG. 13.
Figure 13:
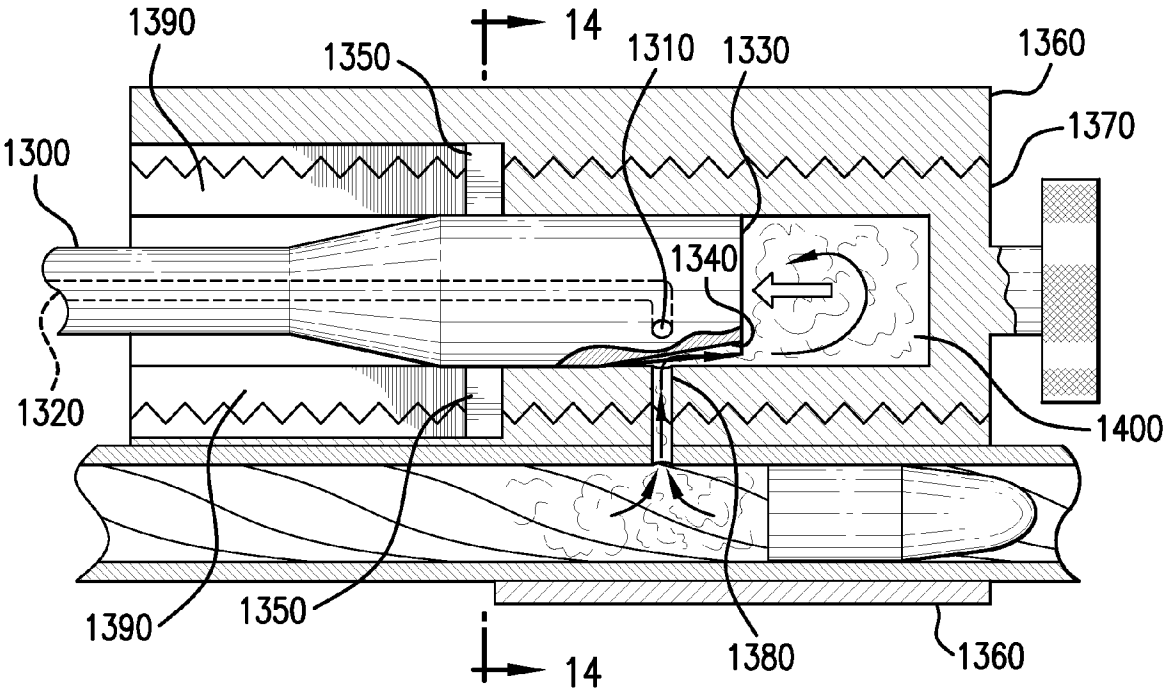
FIG. 13 is a partial sectional side view of an embodiment of the present invention showing the moment after gases from a fired cartridge enter an expansion chamber and act against an operating rod.

FIGS. 13 and 14 illustrate a further embodiment of the present invention. As shown in FIG. 13, the operating rod 1300 includes an operating rod gas duct 1310 coupled to an operating rod gas tube 1320. The operating rod 1300 also includes a forward-end or piston 1330 including a recess 1340. The recess 1340 forms part of the expansion chamber 1400 when the operating rod 1300 is being used to mechanically actuate a bolt carrier. The operating rod 1300 also includes lugs 1350 that can lock the operating rod 1300 into a gas block 1360 for gas-impingement operation. The gas block 1360 includes a gas chamber 1370 that can be removed from the gas block 1360 by unscrewing the gas chamber 1370. When fully screwed in or installed, grooves in the removable gas chamber 1370 align with grooves in the gas block 1360 to form combined grooves 1390. The operating rod lugs 1350 reciprocate along the combined grooves 1390 for piston-driven operation. Each combined groove 1390 can also provide an "L" shaped locking groove or bearing surface so that the operating rod 1300 can be locked into the gas block 1360 using lugs 1350 for gas-impingement operation. The removable expansion chamber 1370 is additionally useful because it can be readily removed for cleaning and maintenance.

FIG. 14 provides a cross-sectional view of the embodiment of FIG. 13. As seen in FIG. 14, the operating rod 1300 includes a gas duct 1310, a gas tube 1320, a recess 1340, and lugs 1350. Expansion gases from a fired cartridge are provided to the gas block 1360 via a gas port 1380. The gas block 1360 includes a removable expansion chamber 1370, with threads 1410 securing the removable expansion chamber 1370 into the gas block 1360. As also shown in FIG. 13, it can be seen that the operating rod 1300 is positioned for piston-driven operation because the recess 1340 is aligned with the gas port 1380.

Figure 15:
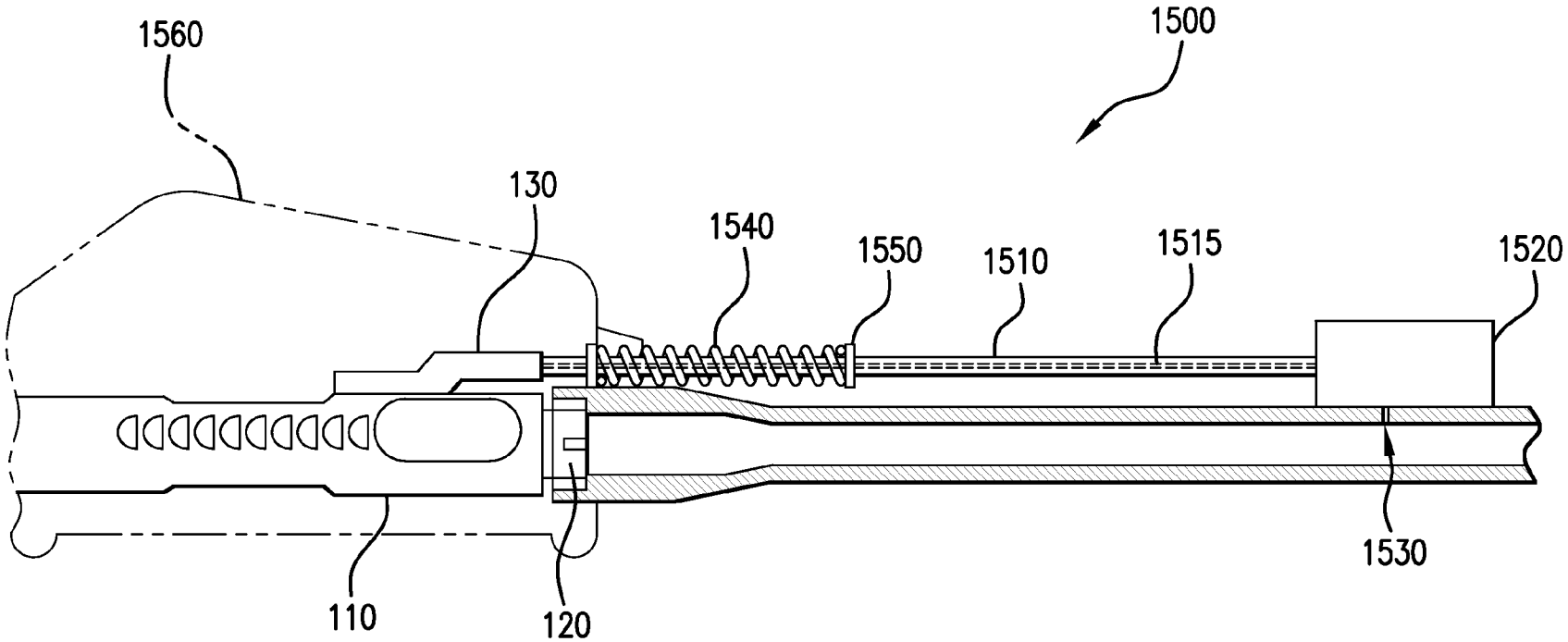
FIG. 15 is a partial sectional side view of a firearm useable with any embodiment of the present invention.

FIG. 15 provides a partial view showing how a firearm 1500 can incorporate various embodiments of the present invention. As seen in FIG. 15, the firearm 1500 includes an operating rod 1510 comprising a gas duct (not shown) and a gas tube 1515. The operating rod of any embodiment of the present invention can be used, including the operating rod described with respect to FIGS. 1-10 and 13-14. The forward-end of the operating rod reciprocates in a gas block 1520 when the operating rod 1510 is used to mechanically actuate a bolt carrier 110. The gas block 1520 receives gases from a fired cartridge through gas port 1530. The gas block of any embodiment of the present invention can be used, including the gas blocks described with respect to FIGS. 6-10 and 13-14. The operating rod 1510 includes a collar 1550 that is used to secure a return spring 1540 that is over the operating rod 1510 between the collar 1550 and a receiver 1560. The receiver 1560 outlined in FIG. 15 represents an M-16/AR-15-type receiver as known to one of skill in the art. The receiver 1560 can include the bolt carrier 110, bolt 120, and carrier key 130 described with respect to FIGS. 11-12, although any suitable bolt carrier, bolt, and/or carrier key can be used. As shown in FIG. 11, a rear end of the operating rod 1510 rests inside the carrier key 130.

A further embodiment of the present invention provides a system for actuating a bolt carrier. The system can comprise an operating rod including an operating rod gas duct coupled to an operating rod gas tube as shown for example in FIGS. 1-10 and 13-15. The operating rod gas duct can receive expansion gases as a function of one or more battery states. The system can for example comprise a first battery state and a second battery state. The first battery state can comprise positioning a forward-end of the operating rod in a gas block to define an expansion chamber, wherein expansion gases flow into the expansion chamber and act against the forward-end of the operating rod, thereby actuating the bolt carrier. The second battery state can comprise positioning the operating rod gas duct to receive expansion gases, wherein expansion gases flow from the operating rod gas duct and through the operating rod gas tube to actuate the bolt carrier by gas-impingement.

FIGS. 6-10 illustrate by way of example the first and second battery states of one embodiment of the present invention. FIGS. 6 and 8, by way of example, show the first battery state. As seen in FIG. 6, the piston 63 of the operating rod 60 is positioned in a gas block 66 to define an expansion chamber. The recess 64 is positioned above the gas port 68 to allow expansion gases from the gas port 68 to enter the expansion chamber and act against the piston 63, thereby causing the operating rod 60 to mechanically actuate a bolt carrier.

FIG. 7 illustrates the second battery state of one embodiment of the present invention. As seen in FIG. 7, the operating rod gas duct 61 has been aligned with the gas port 68, enabling expansion gases to flow from the gas duct 61 and through the gas tube 62 to actuate a bolt carrier. As shown in FIG. 7, the second battery state can further comprise aligning the gas duct 61 with the gas port 68. Similarly the second battery state can further comprise creating a gas pathway between the gas duct 61 and the gas port 68. FIGS. 9-10 show the first and second battery states, respectively, the moment after expansion gases from a fired cartridge flow though the gas port 68.

As shown in FIGS. 6-10, for example, when the system is in the second battery state the operating rod gas duct 61 can be positioned to receive expansion gases, such as from gas port 68, by moving the operating rod 60 to align the gas duct 61 with the gas pathway 68. FIGS. 6-7 show one embodiment where that the operating rod 60 can be moved to align the gas duct 61 with the gas port 68 by rotating the operating rod 60 from its position in the first battery state. Also as shown in FIGS. 6-7 and 9-10, moving or transitioning the operating rod 60 from the first battery state to the second battery state locks the operating rod 60 into the gas block 66 by moving lugs 65 into "L" shaped cuts in the gas block 66. Thus the operating rod 60 in the second battery state is securely positioned so that the gas duct 61 and the gas port 68 remain aligned.

The system of further embodiments can comprise a locking mechanism that locks the operating rod in the gas block when the system is in the second battery state. The locking mechanism can comprise a lug coupled to the operating rod and a bearing surface that engages the lug, as shown, for example, in FIGS. 6-10. The bearing surface can be coupled to a gas block that includes the gas port, a barrel, and/or to a receiver that carriers the bolt carrier. As described with respect to FIG. 5, a control pin 46 can be used to control the position of the operating rod 40 in the systems of the present invention. The control pin can be received by a slot that is included in the gas block, a hand guard, and/or a receiver that carries the bolt carrier.

The systems of the present invention can use the bolt carrier, bolt, and/or carrier key of any embodiment of the present invention. By way of example, the systems can use the bolt carrier 110, bolt 120, and carrier key 130 described with respect to FIGS. 11-12.

Figure 16:
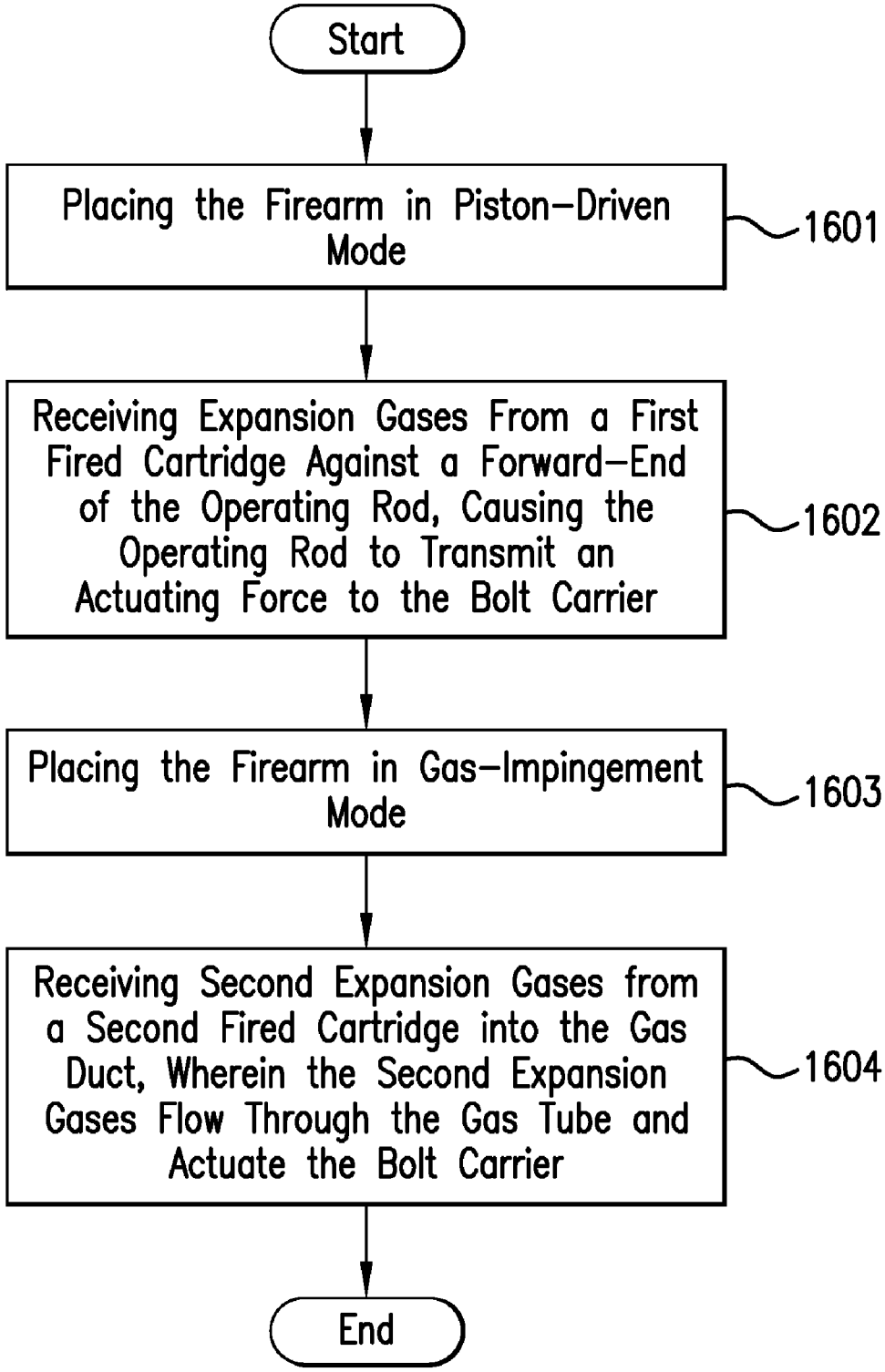
FIG. 16 illustrates the method of one embodiment of the present invention for operating a firearm.

Another embodiment of the present invention as shown in FIG. 16 provides a method for operating a firearm, wherein the firearm includes a bolt carrier carried in a receiver, a barrel coupled to the receiver, a gas block coupled to the barrel and including a gas port for tapping expansion gases from the barrel, and an operating rod that comprises an operating rod gas tube coupled to an operating rod gas duct. The operating rods, systems, and methods of any embodiment of the present invention can be used with any other embodiment described herein, including the embodiments described with respect to FIGS. 1-15.

First, the firearm is placed 1601 in piston-driven mode. Second, while in piston-driven mode first expansion gases from a first fired cartridge are received 1602 against a forward-end of the operating rod, wherein the first expansion gases act against the operating rod and cause it to transmit an actuating force to the bolt carrier. Third, the firearm is placed 1603 in gas-impingement mode. Fourth, while in gas-impingement mode second expansion gases from a second fired cartridge are received 1604 into the operating rod gas duct, wherein the second expansion gases flow through the operating rod gas tube and actuate the bolt carrier.

In further embodiments of the present invention placing 1603 the firearm in gas-impingement mode can comprise positioning the operating rod gas duct to receive the second expansion gases from the second fired cartridge. The operating rod gas duct can be positioned to receive the second expansion gases from the second fired cartridge by aligning the gas duct with the gas port. The operating rod gas duct can also be positioned to receive the second expansion gases from the second fired cartridge by creating a gas pathway between the gas duct and the gas port. The operating rod gas duct can be positioned to receive the second expansion gases from the second fired cartridge by rotating the operating rod relative to its position when the firearm is in piston-driven mode. In addition to or in the alternative, the operating rod gas duct can be positioned to receive the second expansion gases from the second fired cartridge by moving the operating rod rearward or forward relative to its position when the firearm is in piston-driven mode.

Placing 1603 the firearm in gas-impingement mode can also comprise actuating a valve to create a gas pathway between a barrel coupled to the receiver and the operating rod gas duct. Similarly, placing 1601 the firearm in piston-driven mode can comprise actuating a valve to create a gas pathway between a barrel coupled to the receiver and the forward-end of the operating rod.

In further embodiments placing 1603 the firearm in gas-impingement mode can further comprise locking the operating rod in position with respect to the firearm. To accomplish locking the operating rod can comprise one or more lugs that engage one or more bearing surfaces as described, for example, with respect to FIGS. 4-10 and 13-14. The bearing surfaces can be coupled to any suitable location, such as to a gas block that includes the gas port, to a barrel of the firearm, or to a receiver that carriers the bolt carrier.

In further embodiments of the current method the operating rod can include a control pin to control the position and/or rotation of the operating rod. As shown for example in FIG. 5, the operating rod 40 of FIG. 4 can further include a control pin 46. The control pin 46 enables a user to rotate the operating rod 40 and engage or disengage the lugs 45, thereby locking the operating rod 40 into a gas block for gas-impingement operation. The control pin can be received by a slot to control the position and/or rotation of the operating rod. The slot can be located at various locations in embodiments of the present invention. For example, the slot can be coupled to a gas block that includes a gas port, the slot can be coupled to a hand guard, or the slot can be coupled to a receiver that carriers a bolt carrier.

In further embodiments of the current method the forward-end of the operating rod can include a recess that forms part of an expansion chamber in the gas block when the firearm is in piston-driven mode. The recess enables expansion gases to be selectively directed either against the forward-end of the operating rod, such as when the firearm is in piston-driven mode, or into the operating rod gas duct, such as when the firearm is in gas-impingement mode. In piston-driven mode the recess can be aligned with, or uncover, the gas port to enable expansion gases to fill the expansion chamber and act against the operating rod. In gas-impingement mode the forward part of the operating rod can be positioned, such as by rotating the operating rod or by moving it longitudinally, so that expansion gases flow from the gas port into the operating rod gas duct. FIGS. 3-10 and 13-14 show illustrative embodiments including a recessed piston. As shown in FIG. 3, for example, the operating rod 30 includes an operating rod gas duct 31 coupled to an operating rod gas tube 32. The operating rod 30 also includes a forward-end or piston 33 with a recess 34. The recess 34 forms part of an expansion chamber—that is the recess 34 directly receives pressure from expansion gases—when the operating rod 30 is being used to mechanically actuate a bolt carrier. The recess can comprise a beveled edge, groove, or any other suitably shaped space in the forward-end of an operating rod.

Figure 17:
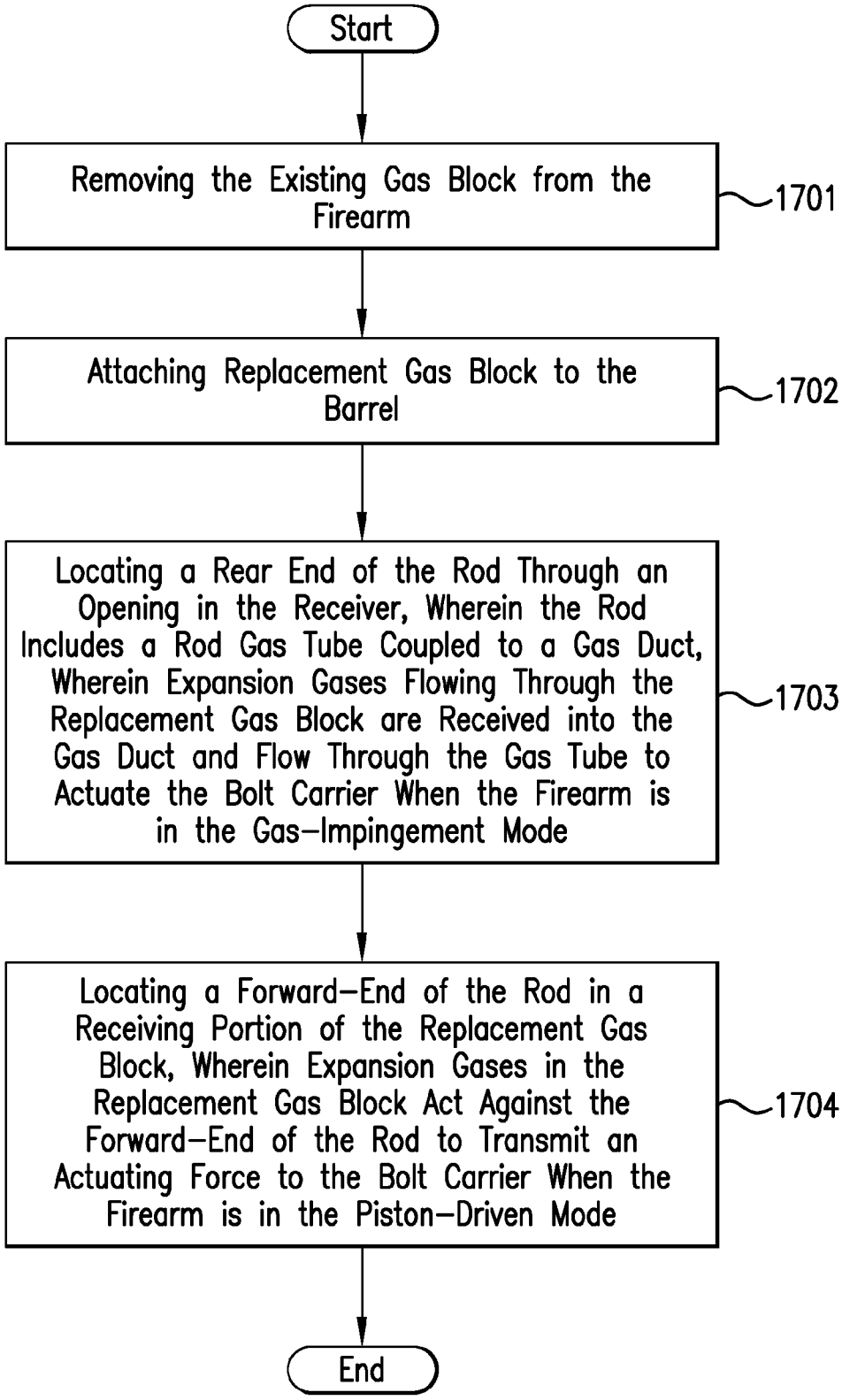
FIG. 17 illustrates the method of another embodiment of the present invention for modifying a firearm to selectively operate in one of a gas-impingement or piston-driven mode.

Any suitable bolt carrier can be used with the methods of the present invention, including the methods described with relation to FIGS. 16 and 17. By way of example and as shown in FIG. 11, a conventional M-16/AR-15-type bolt carrier 110 and bolt 120 can be used. A modified carrier key 130 can enable use of a conventional M-16-type bolt carrier 110 and bolt 120. The carrier key 130 can include a key port 140 for receiving expansion gases from the operating rod gas tube and for directing those gases into the bolt carrier 110 for gas-impingement operation. For mechanical actuation the carrier key 130 can comprise a thrust surface 150, such as a circular shelf or face that receives the rear end of the operating rod, for example, to receive an actuating force from the operating rod when the operating rod is being used to mechanically operate the bolt carrier.

A further embodiment of the present invention as shown in FIG. 17 provides a method for modifying a firearm to selectively operate in one of a gas-impingement or a piston-driven mode, wherein the firearm includes a bolt carrier carried in a receiver, a barrel coupled to the receiver, and an existing gas block coupled to the barrel. First the method comprises removing 1701 the existing gas block from the firearm. Second, a replacement gas block is attached 1702 to the barrel. Third, a rear end of the operating rod is located 1703 in the receiver, the operating rod including an operating rod gas tube coupled to an operating rod gas duct, wherein expansion gases flowing into the replacement gas block are received into the operating rod gas duct and flow through the operating rod gas tube to actuate the bolt carrier when the firearm is in the gas-impingement mode. Fourth, a forward-end of the operating rod is located 1704 into a receiving portion of the replacement gas block, wherein expansion gases in the replacement gas block act against the forward-end of the operating rod to transmit an actuating force to the bolt carrier when the firearm is in the piston-driven mode. Embodiments of the present method can also further include placing the firearm in gas-impingement mode by positioning the operating rod gas duct to receive expansion gases from a gas port of the replacement gas block.

The operating rods, systems, and methods of any embodiment of the present invention can be used with embodiments of the current method, including embodiments described in relation to FIGS. 1-16.

In further embodiments of the present method placing the firearm in gas-impingement mode can comprise positioning the operating rod gas duct to receive an expansion gas from a fired cartridge. The operating rod gas duct can be positioned to receive the expansion gas by aligning the gas duct with the gas port. The operating rod gas duct can also be positioned to receive the expansion gas by creating a gas pathway between the gas duct and the gas port. The operating rod gas duct can be positioned to receive the expansion gas by rotating the operating rod relative to its position when the firearm is in piston-driven mode. In addition to or in the alternative, the operating rod gas duct can be positioned to receive the expansion gas by moving the operating rod rearward or forward relative to its position when the firearm is in piston-driven mode. Placing the firearm in gas-impingement mode can also comprise actuating a valve to create a gas pathway between a barrel coupled to the receiver and the operating rod gas duct. Similarly, placing the firearm in piston-driven mode can comprise actuating a valve to create a gas pathway between a barrel coupled to the receiver and the forward-end of the operating rod.

In further embodiments placing the firearm in gas-impingement mode can further comprise locking the operating rod in position with respect to the firearm. To accomplish locking the operating rod can comprise one or more lugs that engage one or more bearing surfaces as described, for example, with respect to FIGS. 4-10 and 13-14. The bearing surfaces can be coupled to any suitable location, such as to a gas block that includes the gas port, to a barrel of the firearm, or to a receiver that carriers the bolt carrier.

In further embodiments of the current method the operating rod can include a control pin to control the position and/or rotation of the operating rod. As shown for example in FIG. 5, the operating rod 40 of FIG. 4 can further include a control pin 46. The control pin 46 enables a user to rotate the operating rod 40 and engage or disengage the lugs 45, thereby locking the operating rod 40 in position with respect to a bolt carrier for gas-impingement operation. The control pin can be received by a slot to control the position and/or rotation of the operating rod. The slot can be located at various locations in embodiments of the present invention. For example, the slot can be coupled to a gas block that includes a gas port, the slot can be coupled to a hand guard, or the slot can be coupled to a receiver that carriers a bolt carrier.

In further embodiments of the current method the forward-end of the operating rod can include a recess that forms part of an expansion chamber in the gas block when the firearm is in piston-driven mode. The recess enables expansion gases to be selectively directed either against the forward-end of the operating rod, such as when the firearm is in piston-driven mode, or into the operating rod gas duct, such as when the firearm is in gas-impingement mode. In piston-driven mode the recess can be aligned with, or uncover, the gas port to enable expansion gases to fill the expansion chamber and act against the operating rod. In gas-impingement mode the forward part of the operating rod can be positioned, such as by rotating the operating rod or by moving it longitudinally, so that expansion gases flow from the gas port into the operating rod gas duct. FIGS. 3-10 and 13-14 show illustrative embodiments including a recessed piston. As shown in FIG. 3, for example, the operating rod 30 includes an operating rod gas duct 31 coupled to an operating rod gas tube 32. The operating rod 30 also includes a forward-end or piston 33 with a recess 34. The recess 34 forms part of an expansion chamber—that is the recess 34 directly receives pressure from expansion gases—when the operating rod 30 is being used to mechanically actuate a bolt carrier. The recess can comprise a beveled edge, groove, or any other suitably shaped space in the forward-end of an operating rod.

While the invention has been described in detail in connection with specific embodiments, it should be understood that the invention is not limited to the above-disclosed embodiments. Rather, the invention can be modified to incorporate any number of variations, alternations, substitutions, or equivalent arrangements not heretofore described, but which are commensurate with the spirit and scope of the invention. Specific embodiments should be taken as exemplary and not limiting.

I claim:

1. A system for selectively operating a firearm bolt carrier by gas-impingement or mechanical operation, the system comprising:

a receiver that carries the bolt carrier;

a barrel coupled to the receiver, wherein the barrel includes a gas port for tapping expansion gases from the barrel;

an operating rod comprising a forward-end and an operating rod gas duct coupled to an operating rod gas tube, wherein a first expansion gas from the gas port is received by the operating rod gas duct and is then carried through the operating rod gas tube in order to operate the bolt carrier by gas-impingement operation; and an expansion chamber that receives the forward-end of the operating rod, wherein a second expansion gas from the gas port is received into the expansion chamber and acts against the forward-end of the operating rod, thereby causing the operating rod to transfer an operating force to the bolt carrier.

2. The system of claim 1, wherein the operating rod gas duct is positioned to receive the first expansion gas from the gas port.

3. The system of claim 2, wherein the operating rod gas duct is positioned by placing it over the gas port.

4. The system of claim 3, wherein the operating rod is rotated to position the operating rod gas duct over the gas port.

5. The system of claim 2, wherein the operating rod is locked into position with respect to the gas port before being used to operate the bolt carrier by gas-impingement operation.

6. The system of claim 3, wherein the operating rod is locked into position with respect to the gas port before being used to operate the bolt carrier by gas-impingement operation.

7. The system of claim 4, wherein the operating rod is locked into position with respect to the gas port before being used to operate the bolt carrier by gas-impingement operation.

8. The system of claim 2, wherein the operating rod further comprises a control pin that allows a person to position the operating rod gas duct for gas-impingement operation.

9. The system of claim 1, wherein the forward-end of the operating rod is positioned in the expansion chamber to be acted on by the second expansion gas.

10. The system of claim 9, wherein the forward-end of the operating rod is positioned to vent the gas port into the expansion chamber.

11. The system of claim 10, wherein the forward-end of the operating rod comprises a recess.

12. The system of claim 11, wherein the gas port is vented into the expansion chamber by placing the recess over the gas port.

13. The system of claim 12, wherein the operating rod is rotated to position the recess over the gas port.

14. The system of claim 9, wherein the operating rod further comprises one or more lugs that guide the operating rod when it mechanically actuates the bolt carrier.

15. The system of claim 1, wherein the operating rod is locked into position with respect to the gas port before being used to operate the bolt carrier by gas-impingement operation.

16. The system of claim 15, wherein the operating rod further comprises one or more lugs for locking the operating rod into position with respect to the gas port.

17. The system of claim 16, wherein the one or more lugs are used to guide the operating rod when it mechanically actuates the bolt carrier.

18. The system of claim 1, wherein the operating rod further comprises one or more lugs that guide the operating rod when it mechanically actuates the bolt carrier.

19. The system of claim 1, wherein the bolt carrier comprises:

a key port for receiving expansion gases from the operating rod gas tube; and a thrust surface for receiving the operating force from the operating rod.

20. The system of claim 19, wherein the bolt carrier further comprises a carrier key, and wherein the key port and the thrust surface are located on the carrier key.

21. The system of claim 20, wherein the bolt carrier comprises an M-16-type bolt carrier.

* * * * *